US005111873A

United States Patent [19]

Kordovski et al.

[11] Patent Number: 5,111,873

[45] Date of Patent: May 12, 1992

[54] DIE CASTING FRAME

[75] Inventors: Mile A. Kordovski, Rochester; Donald R. Read, Bergen, both of N.Y.

[73] Assignee: General Motors Corporation, Detroit, Mich.

[21] Appl. No.: 685,775

[22] Filed: Apr. 16, 1991

[51] Int. Cl.[5] ..... B22D 33/04

[52] U.S. Cl. ..... 164/312; 164/340; 164/341; 164/342

[58] Field of Search ..... 164/113, 137, 339, 340, 164/341, 342, 303, 312

[56] References Cited

U.S. PATENT DOCUMENTS

| | | | |
|---|---|---|---|
| Re. 27,469 | 9/1972 | Bode, Jr. | 164/128 |
| 1,927,384 | 9/1933 | Bauer | 164/348 |
| 2,028,192 | 1/1936 | Cherry | 164/340 |
| 2,811,761 | 11/1957 | Bauer | 164/348 |
| 3,103,705 | 9/1963 | Letica | 164/342 |
| 3,373,793 | 3/1968 | Smith | 164/348 |
| 3,450,190 | 6/1969 | Mittermaier et al. | 164/348 |
| 3,468,367 | 9/1969 | Bauer | 164/341 |
| 3,547,184 | 12/1970 | Kock et al. | 164/343 |
| 3,610,322 | 10/1971 | Schoffmann | 164/348 |
| 4,206,799 | 6/1980 | McDonald | 164/341 |
| 4,824,351 | 4/1989 | Ramsey | 164/137 |

FOREIGN PATENT DOCUMENTS

| | | | |
|---|---|---|---|
| 52-22379 | 6/1977 | Japan | 164/339 |

*Primary Examiner*—Kuang Y. Lin
*Attorney, Agent, or Firm*—George A. Grove

[57] ABSTRACT

A frame for manufacturing die cast parts comprises a cover half and an ejector half cooperating with each other for die casting a part, the cover half and the ejector half having a closed position for die casting the part and an open position for ejecting the die cast part. The ejector half includes an ejector for ejecting the die cast part. The cover half and the ejector half each comprise a plurality of stacked plates that provide first and second pockets, respectively cooperating with each other to form a closed pocket when the cover and ejector halves are in the closed position. A plurality of cooperating mold blocks for defining a cavity for receiving die cast material are removably secured in the closed pocket and internal passageways in the cover and ejector halves are removably connected to the mold blocks for conveying cooling fluids thereto.

10 Claims, 11 Drawing Sheets

DIE CASTING FRAME

FIELD OF THE INVENTION

The present invention relates generally to a frame for holding a die casting mold and particularly to a frame that can accommodate different die cast molds for different part types.

BACKGROUND OF THE INVENTION

Prior art frames for die cast molds are typically dedicated for one part type. When the part life cycle has expired, the frame typically cannot be used for another part type and has to be discarded. Frames are typically expensive and contribute significantly to the cost of die casting operations. For a part type that has a relatively short product life, it becomes uneconomical to have a dedicated frame. There is, therefore, a need to have a frame that can be used for a number of part types, thereby spreading the cost of the frame over a longer period.

The surfaces of the die cast molds typically require maintenance after several cycles, since the surfaces gradually wear out through constant use. When maintenance is required, the entire frame has to be disassembled in order to remove the mold cavities. The frame is removed from the die casting machine and practically completely torn apart to reach the mold cavities. This is typically a time consuming operation, during which time the die casting machine remains idle. The die casting machine is, therefore, not generating any revenue while the frame is being maintained. There is, therefore, a need for a frame that provides access to the molds during maintenance so that the frame can be returned to the die casting machine as soon as possible, thereby minimizing any downtime on the machine/

A frame requires a number of utilities, such as hydraulics, cooling, electric sensors, etc., that are needed to support the molds. Hydraulic circuits are typically required to power any slides or ejectors. Cooling circuits are needed to cool the molds and the frame itself. Electric sensors are required to sense the closing of the mold prior to injection. These circuits are typically routed in external pipes and conduits in the prior art frame. During periodic maintenance of the molds requiring disassembly of the frame, these pipes and conduits typically have to be disconnected and removed before access can be made to the die cast molds, using valuable time. These pipes and conduits are also prone to break or be damaged when moving the frame from the die casting machine to a work bench for maintenance. There is, therefore, a need for a frame that integrates these utilities within itself and requires minimum disconnection during maintenance of the molds.

The die molds in a prior art frame are typically made integral with portions of the frame. Thus, when machining is required on the molds, a larger mass of metal needs to be handled, typically resulting in decreased machining accuracy. There is, therefore, a need to provide a frame in which the molds can be conveniently disconnected such that only the molds need to be handled for machining or like for greater accuracy.

The present invention addresses the above-cited and other similar problems.

OBJECTS OF THE INVENTION

It is an object of the present invention to provide a frame for a die cast mold that is not dedicated for one part type and can be used for multiple part types.

It is another object of the present invention to provide a frame for a die cast mold that can be relatively quickly disassembled and reassembled when providing access to the molds for maintenance, thereby minimizing downtime on the die casting machine.

It is an object of the present invention to provide a frame for a die cast mold that can provide access to the molds for maintenance while mounted to the die casting machine.

It is another object of the present invention to provide a frame for a die cast mold that has support utilities that are disposed and interconnected internally rather than externally, thereby providing protection to the utilities from breakage during handling of the frame.

It is still another object of the present invention to provide a frame for a die cast mold that has onboard ejector hydraulics, thereby permitting the frame to be used for different type die casting machines.

SUMMARY OF THE INVENTION

Our invention is a generic single cavity frame for a die casting machine. The generic frame is a flexible die cast mold that can run multiple part types. The mold components are arranged such that disassembly and assembly are much simpler than with a conventional mold.

In general, our frame comprises a plurality of cooperating plates and blocks. As will be described, they are arranged and interconnected so as to facilitate easy and efficient service and maintenance of the frame members. The frame is also constructed so that mold changes for the casting of different parts can be made without replacement of the frame or even extensive disassembly of the frame. These advantages arise from the grouping and function of the several plates and blocks. Further, our generic frame is actually smaller and lighter than prior art frames.

Following is a description of the several components that are employed in a preferred embodiment of our invention.

Cover half—the section of the mold that clamps on the stationary side of the die cast machine platen. It includes the cover clamp plate, cover manifold retainer plate, cover cavity retainer plate, cover cavity mold block, cover cavity manifold block and the slide locking blocks.

Ejector half—the section of the mold that clamps to the movable side of the die cast machine platen. It includes the ejector clamp plate, ejector cavity and manifold retainer plates, corner blocks, ejection system, slides, ejector cavity mold block and ejector cavity manifold block.

Clamp plate—a detail component used to fasten the mold half to the machine platen. One is found on the cover half and one on the ejector half.

Slide nose—a movable core that is a component in the ejector half used to define part of the mold surface to cast part shapes. It is attached to the slide carrier and is actuated by hydraulics.

Slide carrier—a detail that attaches to the slide, contains cooling passages, holds the slide wear plates/mechanical retract plates and accommodates the slide locking blocks. It is attached to the slide bracket.

Slide bracket—a detail that attaches to the slide carrier and is the coupler to the hydraulic cylinder that moves the bracket, carrier and slide assembly forward and retracts them back.

Cover cavity mold block—a detail that is contained in the stationary side of the mold and is used to define a part of the mold surface to cast a part shape and provide cooling/heating. It is located in the cover cavity retainer plate.

Cover cavity retainer plate—the detail that holds the cover cavity block and the slide locking blocks and provides for shot sleeve mating to the mold and water to cool the sleeve.

Cover manifold retainer plate—a detail that forms part of the pocket for the cover cavity/manifold mold block assembly.

Ejector cavity mold block—a detail that is contained in the movable side of the frame and constitutes part of the mold that casts a part shape. It also provides cooling/heating and allows the ejector pins to pass through to push the cast part out of the cavity. It is located in the ejector cavity retainer plate.

Ejector cavity retainer plate—the detail that holds the ejector cavity block and slides and contains the hydraulic cylinders, the electrical switches and the bottom wear plates for the slide locking blocks. It also acts as a hydraulic manifold for the cylinders and contains a water cooling circuit.

Ejector cavity manifold plate—the detail that forms part of the pocket for the ejector cavity/manifold mold block assembly. It also acts as a hot oil manifold for the slide noses.

Ejector back-up plate—the detail that bolts to the ejector cavity manifold plate and mates against the back of the ejector cavity manifold block.

Slide locking blocks—details mounted on and projecting from the cover cavity retainer plate that hold the slides in position during injection of metal. When the machine movable platen moves forward to engage the cover and the ejector halves, the slide locking blocks engage with the slide carrier wear plates and the wear plates in the ejector cavity retainer plate to keep the slides in the closed position.

Carrier wear plates—details that mate with the slide locking blocks. Wear plates can be reworked to re-time the locking blocks without altering the locking blocks. They are located in the slide carriers.

Carrier slide retract wear plates—details that mate with the slide locks to actuate the slide retract motion during the machine opening cycle. Plates are replaceable as they wear. They are bolted to the slide carriers.

Frame wear plates—details that are located in the ejector holder block and mate with the opposite face of the slide locking blocks than the top wear plates.

Cover vacuum block—a detail that is located on the cover cavity retainer plate and contains the locking wedge for the ejector vacuum block. It is a part of the air evacuation system of the cavity during the injection cycle.

Ejector vacuum block—a detail that is located on the ejector cavity retainer plate and casts the main vacuum runner/feature shape. It is part of the air evacuation system for the cavity.

Vacuum carrier assembly—details such as the hydraulic cylinder, the yokes, the switch and the pins that act to move the vacuum valves forward and retract.

Ejection system—the entire mechanism that allows for the casting to be pushed away from the cavity shape in the ejector half. It includes the ejector pins, the return pins, the main ejector plate, the sub-ejector plate and the hydraulic cylinders that actuate the system.

Ejector pins—details that actually push against the casting to remove it from the cavity surface.

Main ejector plate—a detail that is physically attached to the hydraulic ejection cylinders and moves forward and back during the ejection cycle. It holds the return pins and the sub-ejector plate.

Sub-ejector plate—a detail that actually carries the ejector pins that push the casting out of the cavity. It is bolted to the main ejector plate.

Return pins—details that are attached to the main ejector plate and position the ejector plate in the fully retracted mode during closing of the cover and ejector die halves. The pins move through the holder block.

Major parting line—the level at which the cover and ejector die halves meet during the closed/ injection cycle.

Corner blocks—details that are bolted to the ejector cavity retainer plate block in four corners. They make up the major parting line along with the slides.

Ejector split line—the level at which the ejector die half can be physically separated to expose the back of the ejector cavity block and the sub-ejector plate.

Cover split line—the level at which the cover die half can be physically separated to expose the back of the cover cavity block.

Cavity pocket—the space where the cavity block fits in the retainer plates, either the cover or the ejector half.

Frame locator plates—rest buttons in the cavity pocket in the retainer plates that are used to position the cavity block, in both the cover and the ejector halves.

Frame locator pins—pins used to push the cavity blocks against the locator plates for location.

They are found in both the cover and the ejector halves.

These and other objects and characteristics of the present invention will become apparent from the following detailed description.

DETAILED DESCRIPTION OF THE INVENTION

Figure 1:
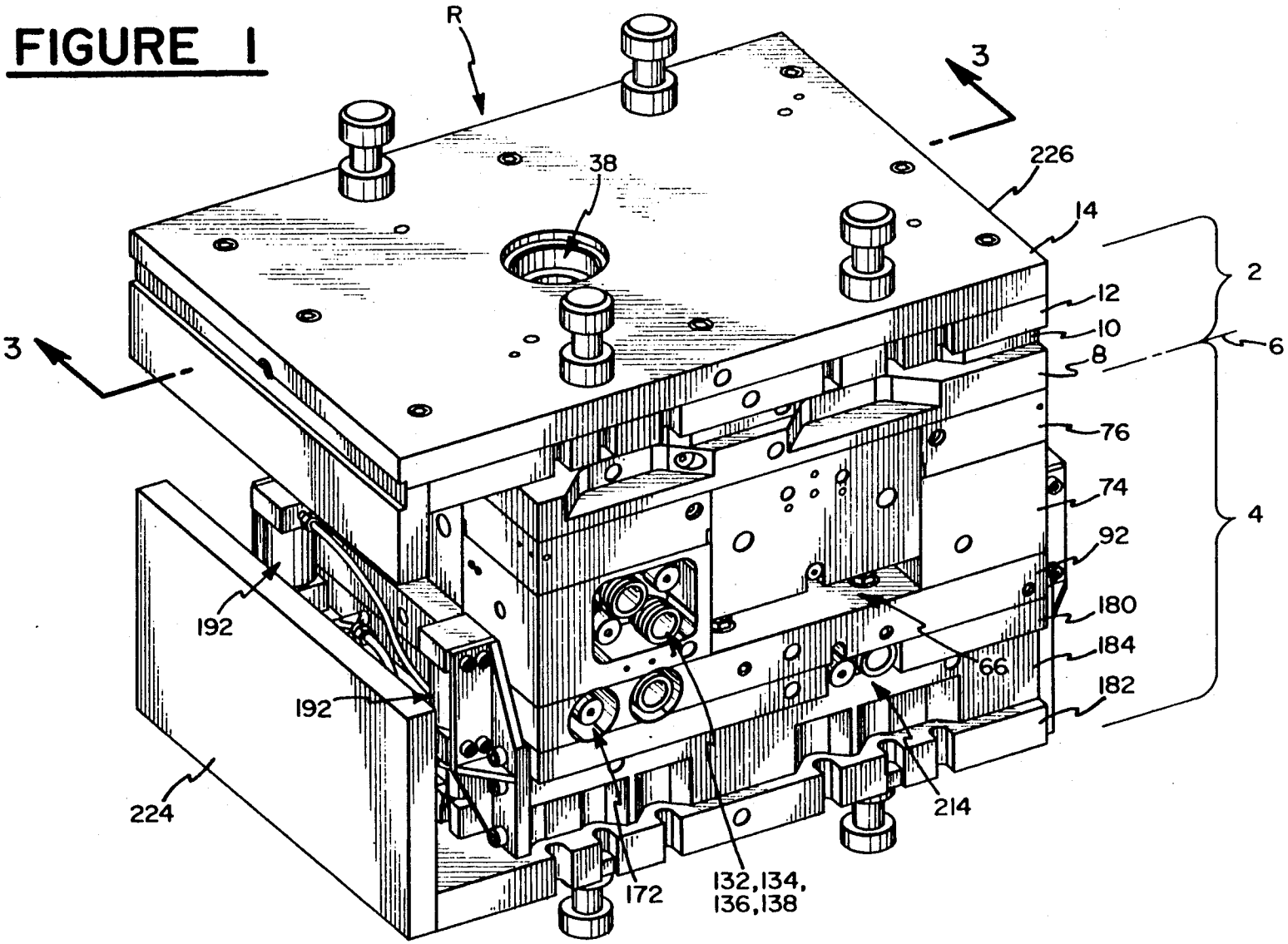
FIG. 1 is a perspective view of a frame, for a die cast mold made in accordance with the present invention.

An embodiment of a frame R for a die cast mold made in accordance with the present invention is disclosed in FIG. 1. The frame R is used in a die casting machine (not shown), where a cover half 2 is mounted to a stationary platen or side of the machine and an ejector half 4 is secured to a movable platen or side of the machine. During operation, the frame R is parted along a main parting line (surface) 6 by the die casting machine. The cover half 2 and the ejector half 4 each comprise a plurality of plates joined together by bolts in a stacked configuration.

The Cover Half

Figure 2:
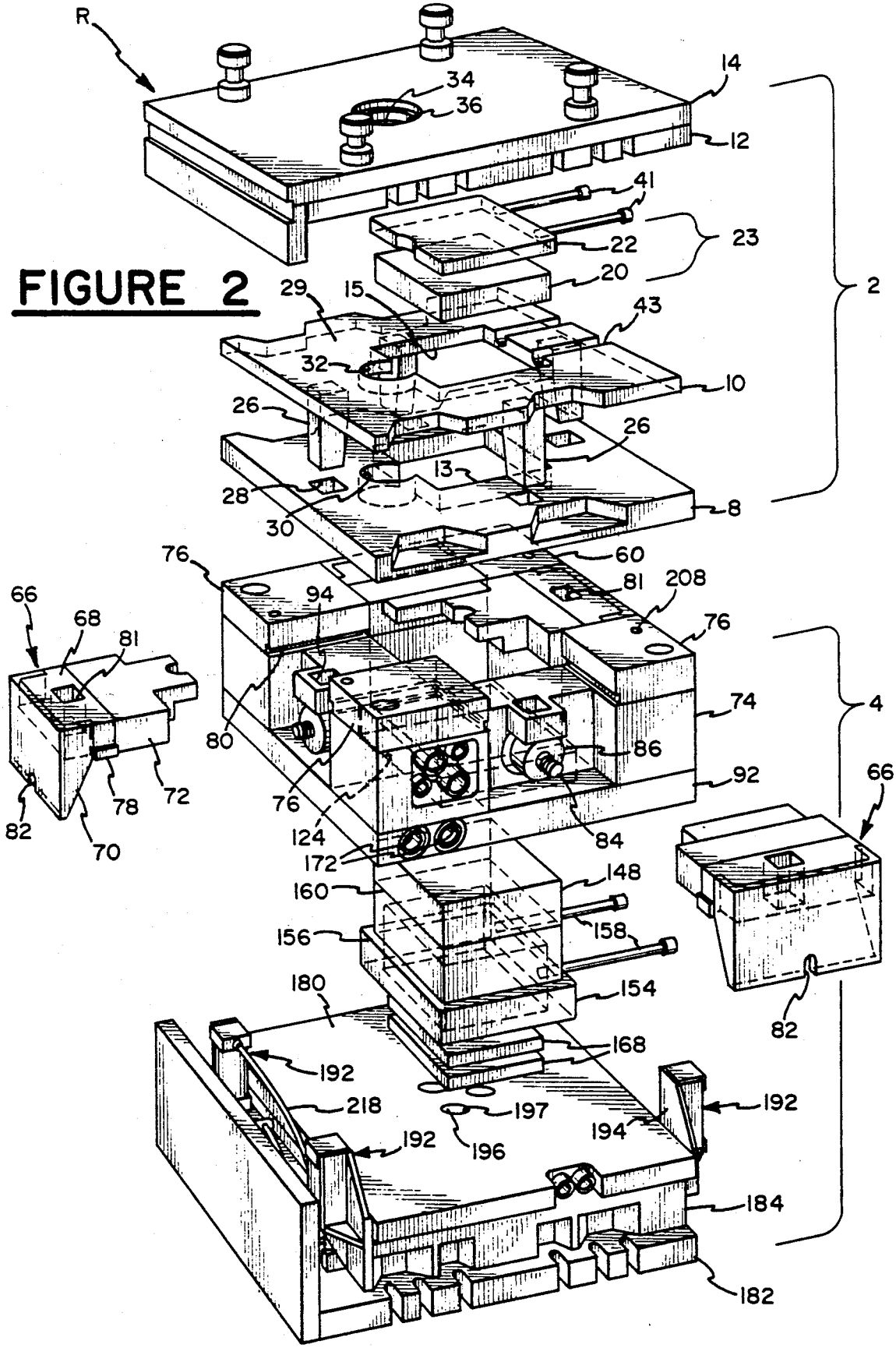
FIG. 2 is an exploded view of the frame shown in FIG. 1.

The cover half 2 comprises in series a cover cavity retainer plate 8, a cover manifold retainer plate 10, and a cover clamp plate 12, as best shown in FIGS. 1 and 2. A conversion clamp plate 14 (shown with four mounting brackets) may be used to configure the frame R to a different die casting machine.

Figure 3:
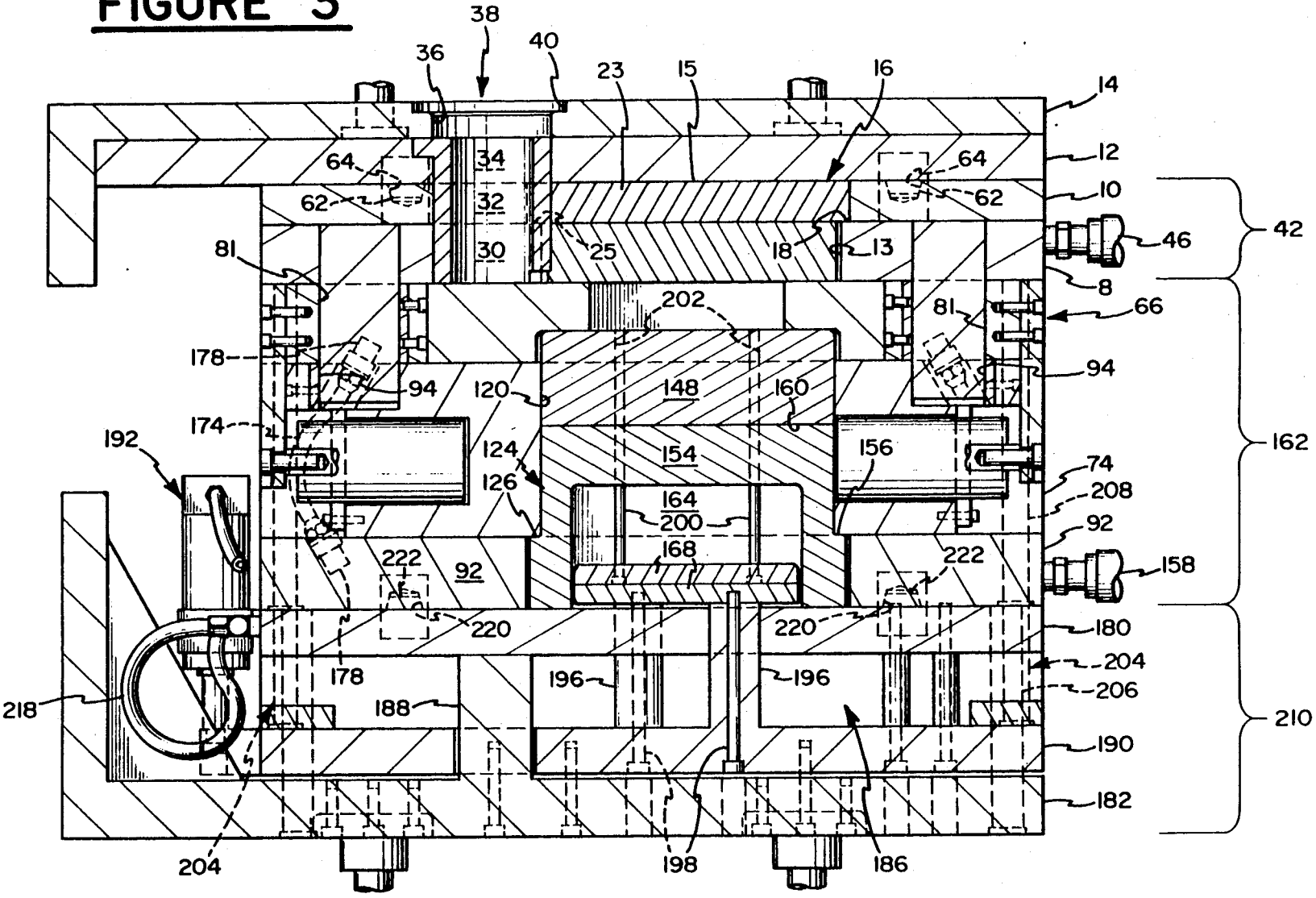
FIG. 3 is a cross-sectional view of the frame taken along lines 3—3 shown in FIG. 1.

The plate 8 has an opening or pocket 13 that cooperates with an opening or pocket 15 in the plate 10 to form a stepped combined opening or pocket 16 with an annular shoulder 18, as best shown in FIG. 3. A cover cavity block 20 bolts to a cover manifold block 22 to form a unit 23 that fits inside the stepped pocket 16. The cover cavity block 20 fits inside and through the pocket 13 in plate 8, while the manifold block 22 fits inside the pocket 16 and is supported along the shoulder 18. The cover manifold block 22 is larger in plan view than the cover cavity block 20 to form an annular shoulder 25 that rests on the cooperating shoulder 18 of the pocket 16, as best shown in FIG. 3. The cover cavity block 20 has a die face that cooperates with other die faces and slide noses 72 (FIG. 6) in the frame R to form a complete die cavity for receiving molten metal used in casting a part.

Figure 4:
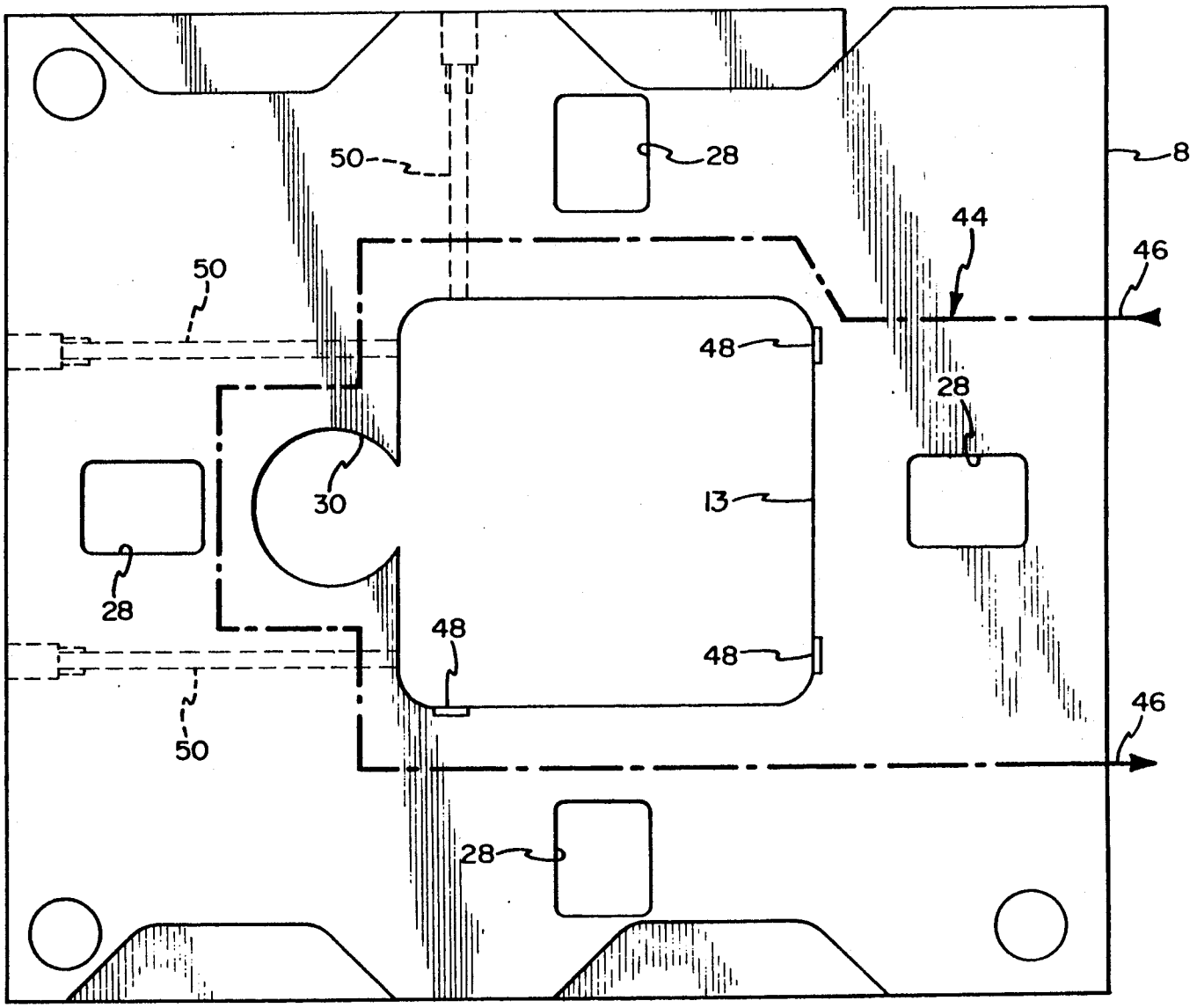
FIG. 4 is a plan view of a cover cavity retainer plate, showing an internal cooling circuit in dashed lines, in accordance with the present invention.

Lock wedges 26 project transversely from the plate 10 and extend beyond the plate 8 through openings 28, as best shown in FIGS. 2, 3 and 4. The lock wedges 26 are bolted to the backside 29 of the plate 10, making them accessible, as will be described below, if maintenance is needed.

Openings 30, 32, 34 and 36 disposed in plates 8, 10, 12 and 14, respectively, cooperate with each other to form a shot hole 38 with a shot sleeve pocket 40, as best shown in FIG. 3.

The cover cavity block 20 has internal passages (not shown) that connect with internal passages (not shown) in the cover manifold block 22. These passages connect to inlet and outlet pipes 41 extending parallel to the plate 10. Recesses 43 receive the pipes 41 so that the plate 10 can be secured flat to the clamp plate 12, as best shown in FIG. 3. The cover manifold block 22 is used to provide oil to cool and heat the cover cavity block 20.

An assembly comprising the cover cavity retainer plate 8 and the cover manifold retainer plate 10 normally remains as a unit 42 that need not be disassembled during normal maintenance on the cover cavity block 20. The unit 42 is secured to the clamp plate 12 or the conversion plate 14, if one is used, with bolts (not shown) that are accessible from the clamp plate 12 or the conversion plate 14. This advantageously provides for the separation of the cover half 2 into two separable units; namely, unit 42 and the cover plate 12, including conversion plate 14 (if used) when access is needed to the cover cavity block 20 for maintenance.

The cover cavity retainer plate 8 has internal passageways 44 for conducting fluid, such as water, for cooling the shot hole 38 and the plate 8 itself. The passageways terminate in inlet and outlet connectors 46, as best shown in FIGS. 3 and 4. The passageways 44 are made by drilling edgewise into the plate 8 at various locations and plugging openings that are not needed.

The opening 13 is slightly larger than the cover cavity block 20. This advantageously provides for ease in the placement or removal of the cover cavity block 20. Means for consistently and accurately locating the cavity block 20 in the opening 13 includes datum locator plates 48 that stick out from the edge of the opening 13 and provide three reference points. Locator pins 50 disposed in corresponding holes in the plate 8 push the cover cavity block 20 against the locator plates 48, positioning the cover cavity block 20 against two axes. Securing the clamp plate 12 against the cover manifold plate 10 fixes the cover cavity block 20 against a third axis.

Figure 5:
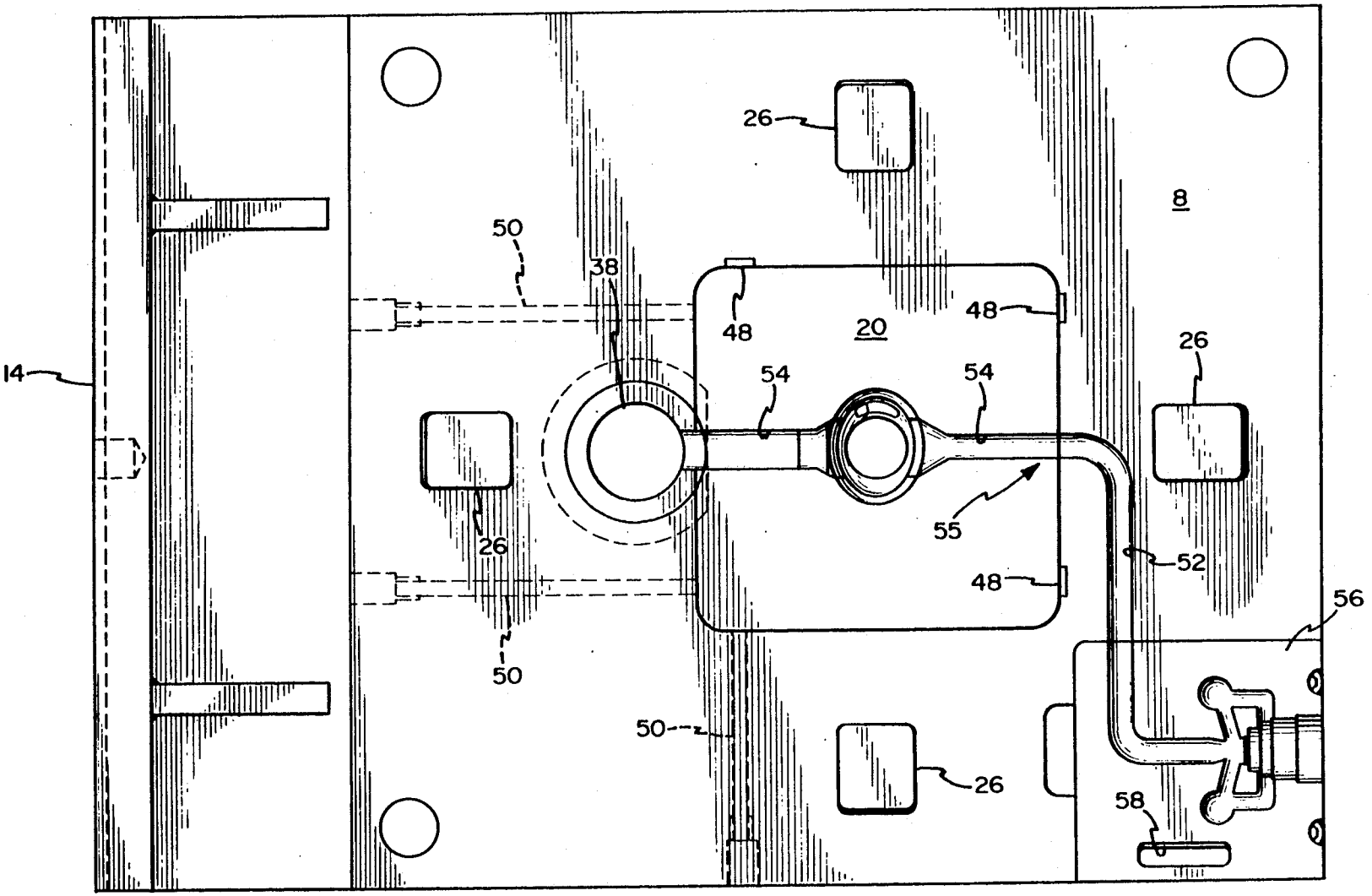
FIG. 5 is a bottom plan view of the cover half at the main parting line of the frame of FIG. 1.

A bottom view of the cover half 2 as fully assembled is disclosed in FIG. 5. The plate 8 includes a recess 52 that connects with a recess 54 in the cover cavity block 20 to form a passageway 55 for the molten metal from the shot sleeve hole 38, to the mold cavity and to a cover vacuum block 56 disposed in the ejector half 4 when the cover half 2 is closed onto the ejector half 4. A vacuum wedge lock 58 cooperates with an ejector vacuum block 60 (FIG. 11) disposed in the ejector half 4. The cover vacuum block 56 (FIG. 5) can be removed while the frame R is in the die casting machine.

Tapered dowels 62 projecting from the clamp plate 12 and arranged in an offset pattern cooperate with respective recesses 64 disposed in the opposing surface of the manifold retainer plate 10 to aid in fool-proof assembly of the unit 42 to the clamp plate 12.

The Ejector Half

The ejector half 4 of the frame R comprises a plurality of slide carriers 66 (see FIG. 6) having a body 68 and a bracket 70. A removable and replaceable slide nose 72 is secured to each of the slide carriers 66 by means of bolts 73. Each of the slide carriers 66 is disposed above an ejector cavity retainer plate 74 and is slidable relative thereto. Corner blocks 76 are disposed on each side of each of the slide carriers 66 such that a rectangular exterior shape is formed thereby. A projecting flange 78 on opposite sides of the slide carrier body 68 cooperates with corresponding grooves 80 on respective sides of the corner blocks 76 to keep the slide carrier 66 along a fixed axis of movement as it moves forward into and retracts from the frame R during die casting operation, as best shown in FIGS. 2 and 6.

Each of the slide carrier bodies 68 has an opening 81 that cooperates with corresponding lock wedge 26 to lock the slide carrier 68 in the closed position during die casting.

Figure 6:
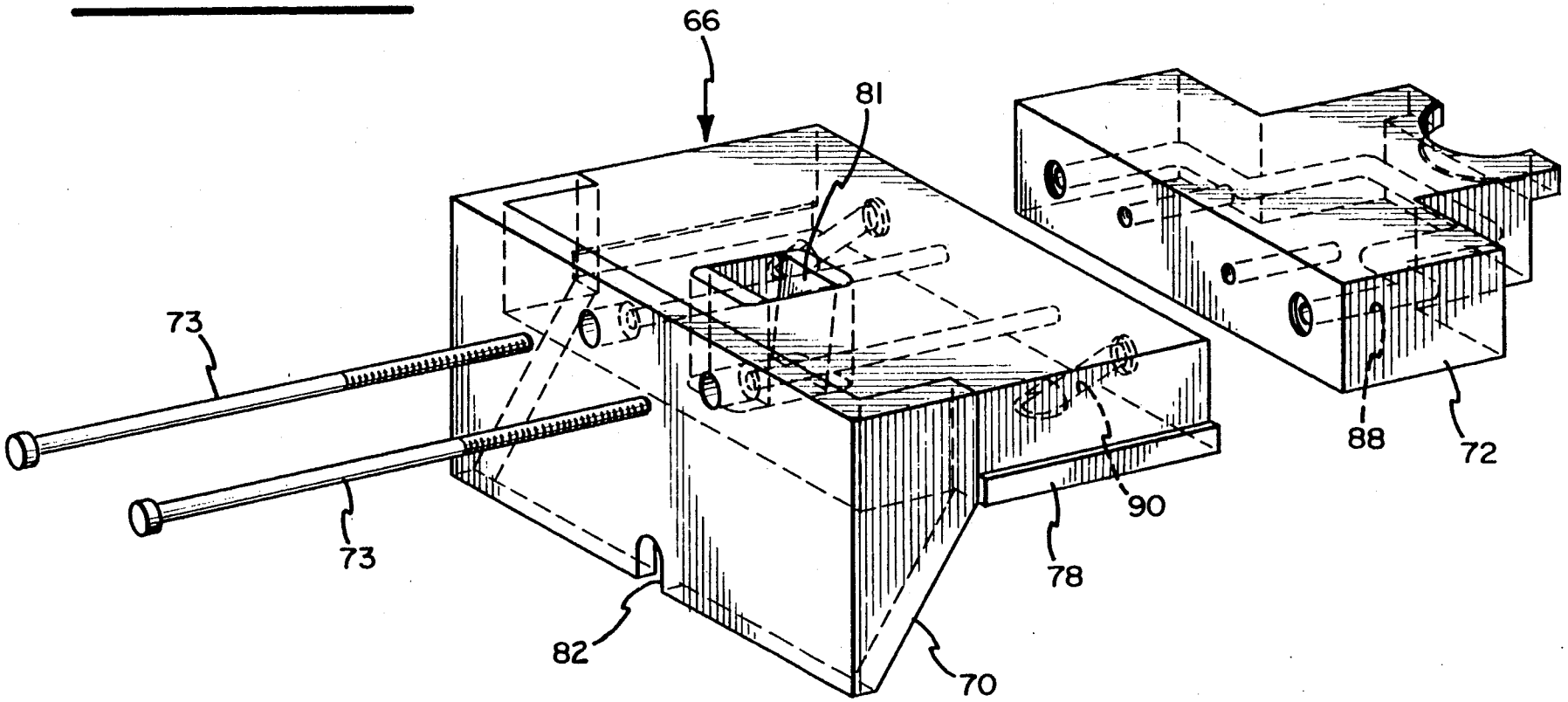
FIG. 6 is a perspective exploded view of a slide carrier and a slide nose in accordance with the present invention.

Each of the slide carrier brackets 70 has a yoke 82 that is operably associated with a rod 84 (FIG. 2) of a respective piston/cylinder assembly 86 to actuate the slide carriers 66 during use, as best shown in FIGS. 6 and 7. The slide brackets 70 are flush with the outside edges of the frame R.

Each of the slide carriers 66 acts as a manifold for supplying cooling fluid to the respective slide nose 72. Internal passageways 88 in each of the slide noses 72 connect to the corresponding passageway 90 in the slide carrier 66, as best shown in FIG. 6. O-rings (not shown) provide sealing means between the opposing interfaces of the respective slide carrier 66 and the slide nose 72. Similar passageways and connection means are used for the cover cavity block 20 and the cover manifold block 22.

The corner blocks 76, in cooperation with the slide carriers 66, provide a top planar surface that mates with a corresponding bottom planar surface of the cover half 2 at the main parting line 6 when the frame R is closed prior to injection of the molten metal. These planar surfaces define the main parting line 6.

The corner blocks 76 can be made in whatever thickness is required to run castings of various thickness. The corner blocks 76 can be made wider to fill in the space occupied by one, two, three or four slide carriers 66 and slide noses 72 so that the frame R can be used without them. The corner blocks 76 are secured to the underlying ejector cavity retainer plate 74.

An ejector manifold retainer plate 92 bolts to the ejector cavity retainer plate 74.

Figure 7:
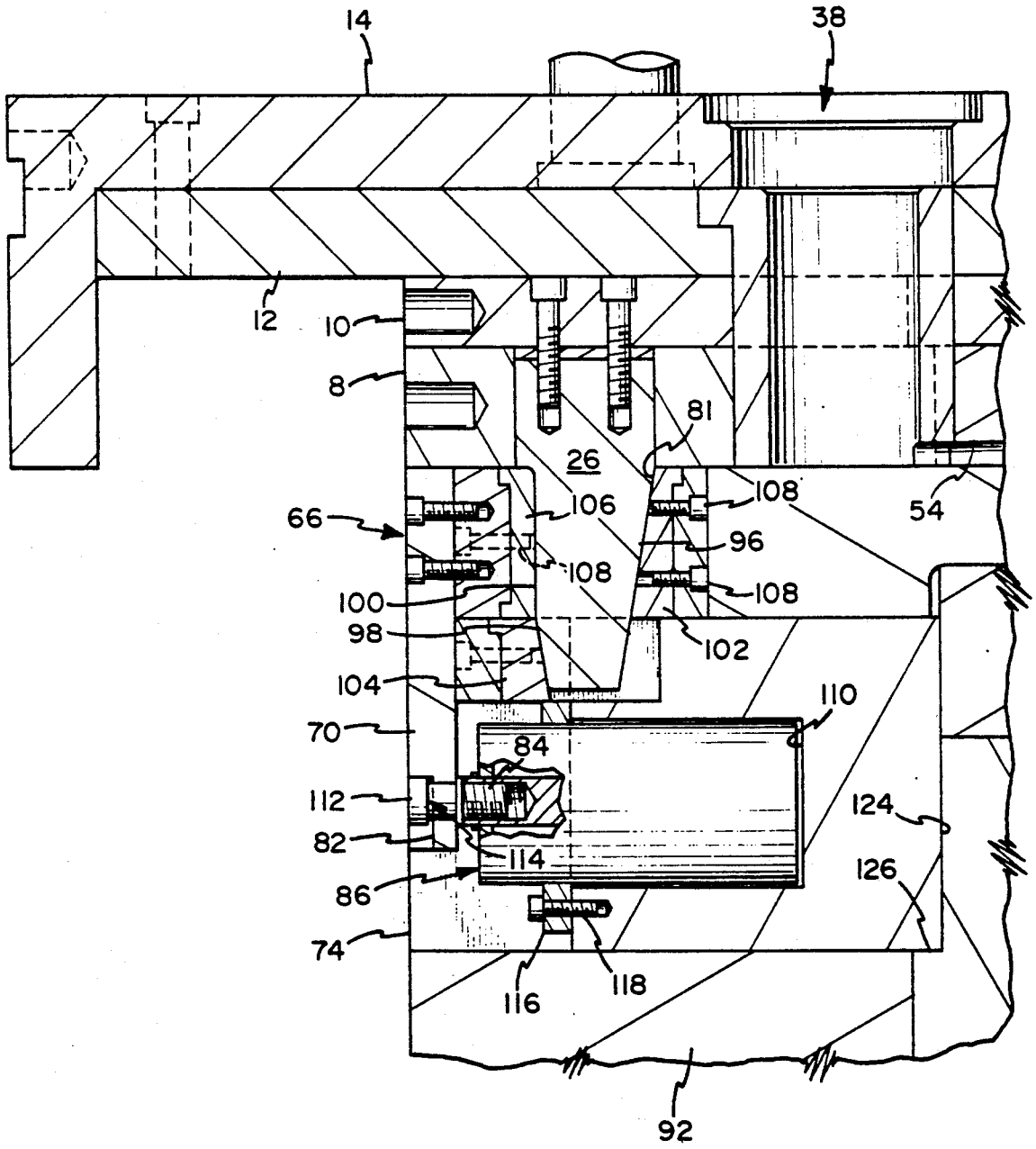
FIG. 7 is a fragmentary enlarged cross-sectional view of a locking mechanism in accordance with the present invention.

The plate 74 has recesses 94 that cooperate with the corresponding openings 81 in the slide carrier bodies 68 and the lock wedges 26 to lock the slide carriers 66 in the closed position, as best shown in FIGS. 3 and 7. Referring to FIG. 7, the wedge 26 has cam surfaces 96 and 98 and vertical surface 100 that cooperate with wear plates 102, 104 and 106, respectively. The wear plates 102, 104 and 106 are made of softer material than the wedge 26 and can be repaired or replaced as required without reworking the wedge 26. The wear plates are secured in the opening 81 and recess 94 by socket head screws 108. The cam surface 100 and the cooperating wear plate 102 provide a mechanical lock for the slide carrier 66 for mechanically stripping the die cast part from the slide nose 72. The cam surface 98 and the cooperating wear plate 104 provide positive locking action for the slide carrier 66 against the metal injection forces.

The mechanical retract feature insures that the slide carriers 66 will not rely on hydraulic force to strip the casting from the die faces. Thus, when a larger part is run in the frame R, the same piston/cylinder assemblies can be used to actuate the slide carriers 66, providing for greater versatility for the frame R.

Each of the piston/cylinder assemblies 86 is disposed within a pocket 110 in the ejector cavity retainer plate 74, as best shown in FIG. 7. A bolt 112 secures the slide carrier bracket 70 via the yoke 82 to the piston/cylinder rod 84. A clearance 114 is provided between the bolt 112 and the bracket 70 to allow for the mechanical retract action of the wedges 26 during opening of the frame R at the main parting line 6. Each of piston/cylinder assemblies 86 is secured to the ejector cavity retainer plate 74 by means of a flange 116 and bolts 118, as best shown in FIG. 7.

Figure 8:
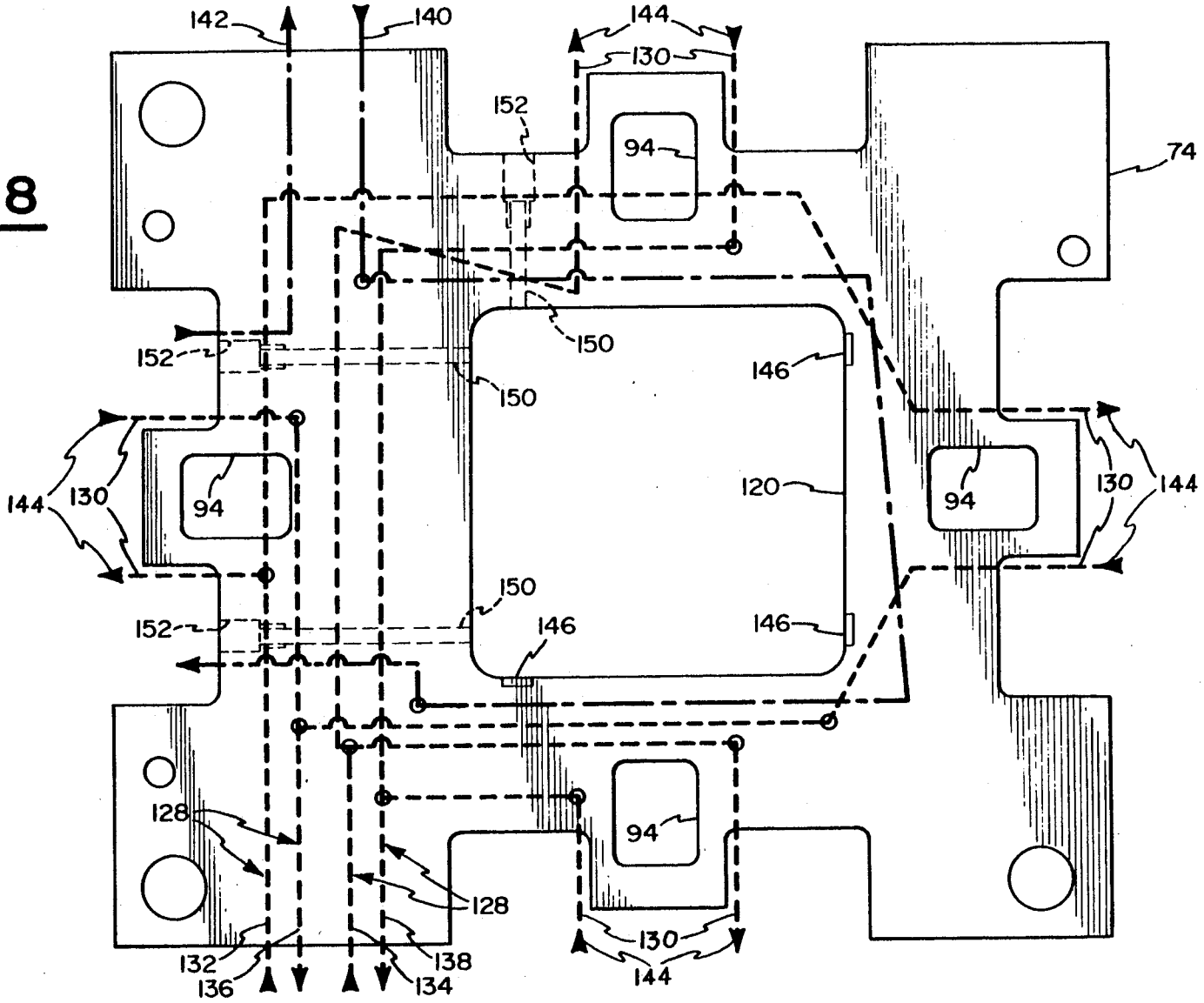
FIG. 8 is a plan view of an ejector cavity retainer plate, showing internal hydraulic and water circuits in dashed lines, in accordance with the present invention.
Figure 9:
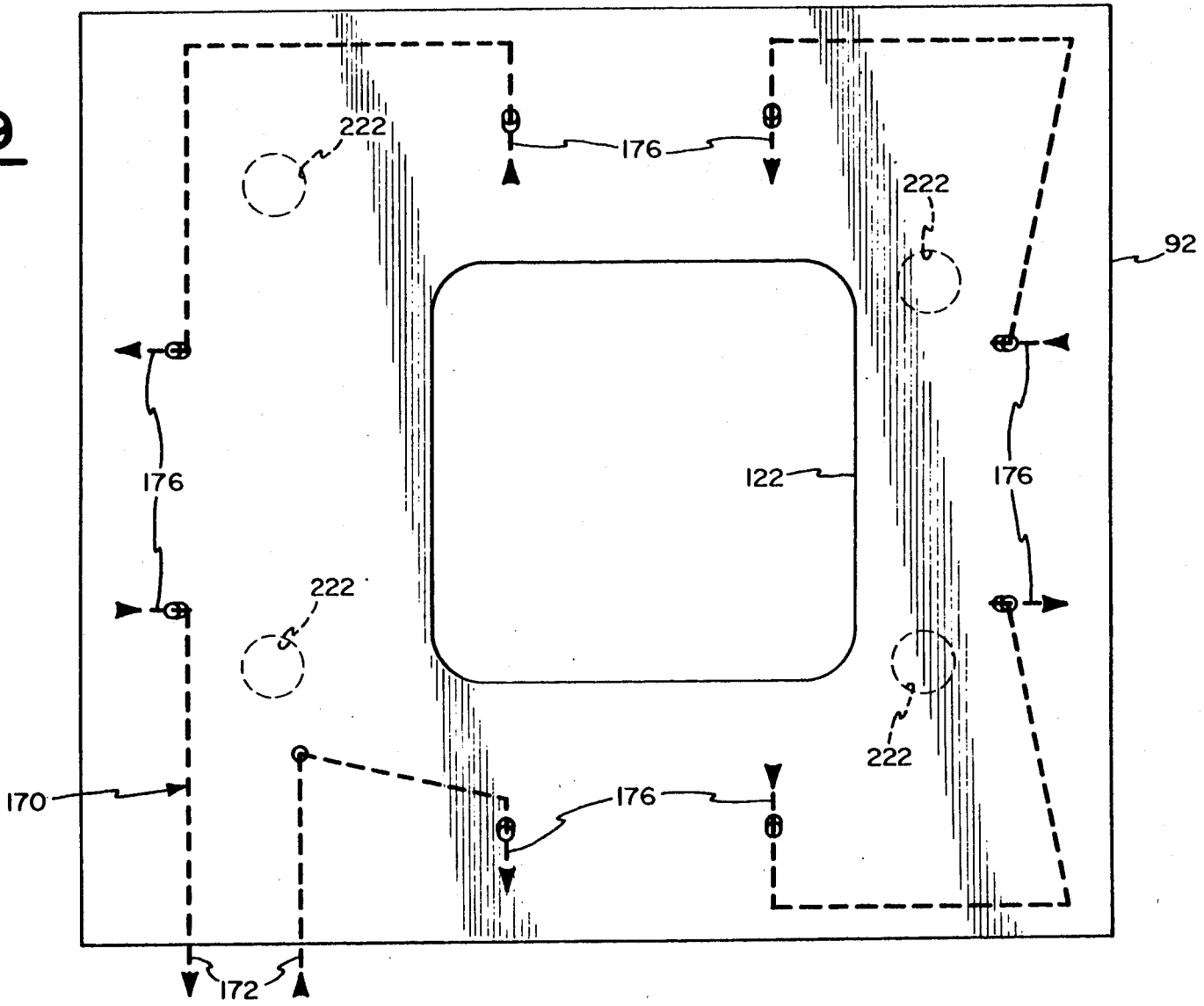
FIG. 9 is a plan view of an ejector manifold retainer plate, showing internal heating/cooling oil circuits in dashed lines for the slide carrier and slide nose in FIG. 6, in accordance with the present invention.

The ejector cavity retainer plate 74 has an opening or pocket 120 that cooperates with an opening or pocket 122 in the ejector manifold retainer plate 92 to form a stepped opening or pocket 124 with an annular shoulder 126, as best shown in FIGS. 3, 8 and 9.

The ejector retainer plate 74 has internal passageways 128 that form two hydraulic circuits for the piston/cylinder assemblies 86, as best shown in FIG. 8. Other internal passageways 130 form a circuit for cooling fluid, such as water, to cool the hydraulic fluid in the passageways 128 and the plate itself. Inlet connectors 132 and 134 and outlet connectors 136 and 138 provide connection means for the hydraulic circuits within the ejector cavity retainer plate 74 to an outside source. Similarly, inlet and outlet connectors 140 and 142, respectively, provide connection of the internal cooling circuit to an outside source. Connection points to the individual piston/cylinder assemblies 86 are schematically indicated at 144.

Datum locator plates 146 are disposed along two edges of the opening 120 to insure consistent and repeatable positioning of an ejector cavity block 148 therein. Locator pins 150 disposed in threaded holes 152 push the ejector cavity block 148 against the locator plates 146.

The ejector cavity block 148 is removable and replaceable and is bolted to an ejector manifold block 154 to form a unit that fits within the stepped pocket 124, as best shown in FIG. 3. The ejector manifold block 154 has a shoulder 156 that cooperates with the pocket shoulder 126 to hold the unit, as best shown in FIG. 3. Inlet and outlet conduits 158 connect to the ejector manifold block 154 and are received within recesses (not shown) in the bottom side of the ejector manifold retainer plate 92. The conduits 158 connect to internal interconnected passageways (not shown) in the ejector manifold block 154 and the ejector cavity block 148. O-rings (not shown) are used to seal the passageways at interface 160 between the ejector cavity block 148 and ejector cavity manifold block 154.

The assembly comprising the corner blocks 76, the slide carriers 66, the ejector cavity retainer plate 74 and the ejector manifold retainer plate 92 normally remains as a unit 162 that advantageously need not be disassembled during normal maintenance on the ejector cavity block 148.

Dual Ejector Plate System

The ejector cavity manifold block 154 has a pocket 164 that receives a pair of sub-ejector plates 168, as best shown in FIG. 3.

The ejector manifold retainer plate 92 has internal passageways 170 that make up a circuit for distributing cooling or heating fluid to the slide carriers 66. Inlet and outlet connectors 172 connect the circuit to an outside source. Flexible conduits 174 connect the circuit to the slide carriers 66 at points 176 with connectors 178, as best shown in FIGS. 3 and 9.

An ejector backup plate 180 is secured to an ejector clamp plate 182 by means of a spacer bracket 184 such that a space 186 is maintained between the plates 180 and 182, as best shown in FIG. 3. Support posts 188 bolt to the ejector clamp plate 182 and sit against the ejector backup plate 180 to provide support against the injection forces on the mold cavity, as best shown in FIG. 3.

A main ejector plate 190 is disposed within the space 186 and is movable between retracted and extended positions by means of piston/cylinder assemblies 192. Support brackets 194 mount the piston/cylinder assemblies 192 to the backup plate 180, as best shown in FIGS. 1 and 2. Dowels 196 are welded to the main ejector plate 190 at one of their ends and are secured to the sub-ejector plates 168 at their other ends with bolts 198 that are accessible from the clamp plate 182, as best shown in FIG. 3. The dowels 196 protrude through holes 197 in the ejector backup plate 180 when the main ejector plate 190 is actuated.

Ejector pins 200 are secured to the sub-ejector plates 168 and are received in holes 202 in the ejector cavity block 148 and the ejector manifold block 154.

Return pins 204 are used as a backup to the piston/-cylinder assemblies 192 to insure that the main ejector plate 190 and hence the ejector pins 200 are retracted in each cycle when the die blocks are brought together for the next casting. The return pins 204 comprise lower return pins 206 that are attached to the main ejector plate 190 and return floating pins 208 that are disposed in respective holes in the ejector manifold retainer plate 92, the ejector cavity retainer plate 74 and the respective corner blocks 76.

The assembly comprising the backup plate 180, the clamp plate 182, the main ejector plate 190, the piston cylinder assemblies 192 and the lower return pins 206 stays as a unit 210 during normal disassembly of the frame R to gain access to the ejector cavity block 148 for maintenance. This unit 210 is secured to the backside of the ejector manifold retainer plate 92 by means of bolts (not shown) that are accessible from the clamp plate 182.

The backup plate 180 has internal passageways 212 that make up a hydraulic circuit for the piston/cylinder assemblies 192. Inlet and outlet connectors 214 provide means for connecting the internal circuit to an outside source. The piston/cylinder assemblies 192 are connected to the circuit at connection points 216 with hoses 218, as best shown in FIGS. 2 and 10.

Figure 10:
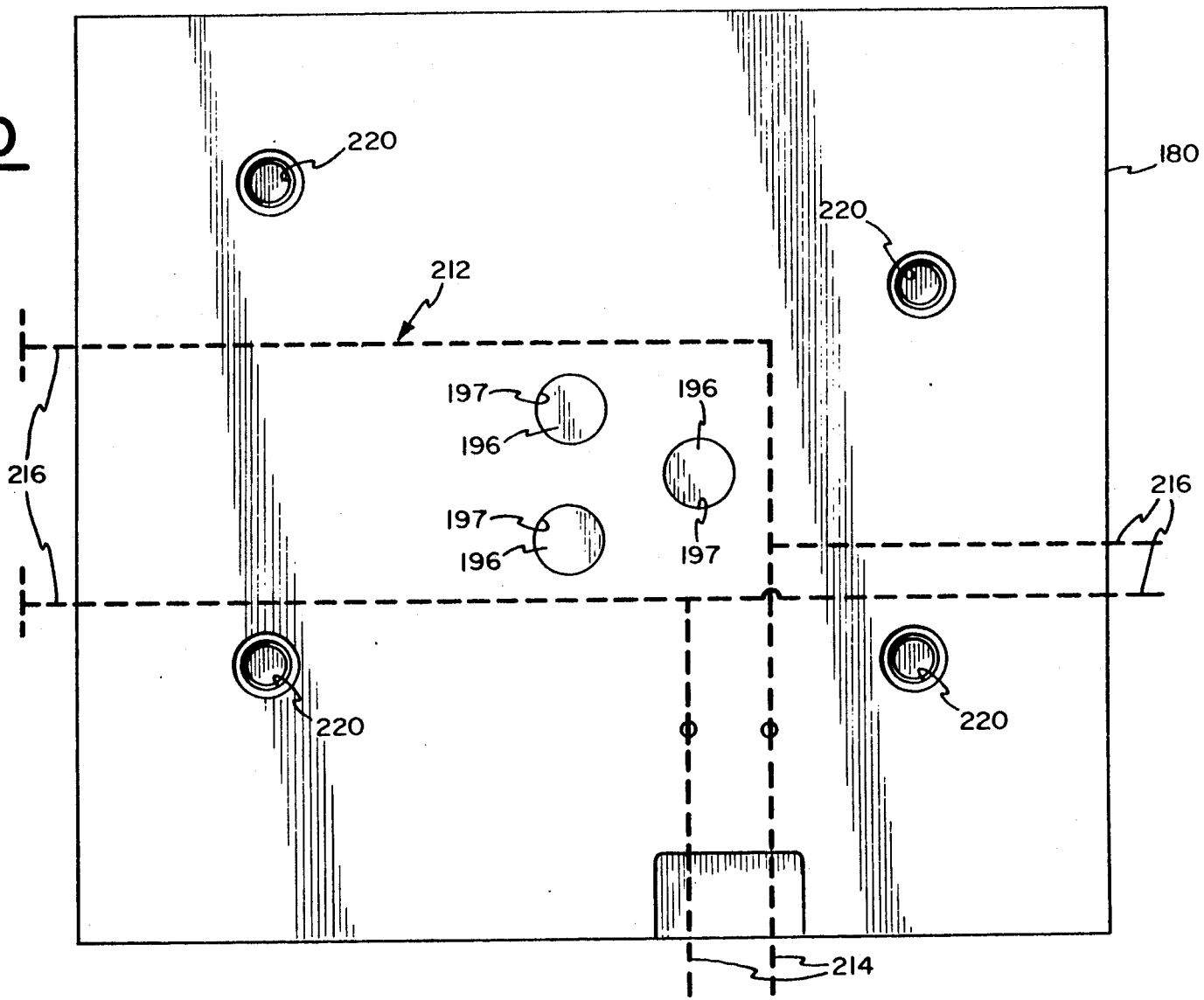
FIG. 10 is a plan view of an ejector backup plate, showing internal hydraulic circuits for piston/cylinder assemblies in dashed line, in accordance with the present invention.

The backup plate 180 has tapered dowels 220 projecting therefrom that cooperate with corresponding tapered recesses 222 disposed on the opposing side of the ejector manifold retainer plate 92, as best shown in FIGS. 3 and 10. The dowels 220 and the recesses 222 are arranged in an offset pattern for fool-proof assembly.

Figure 11:
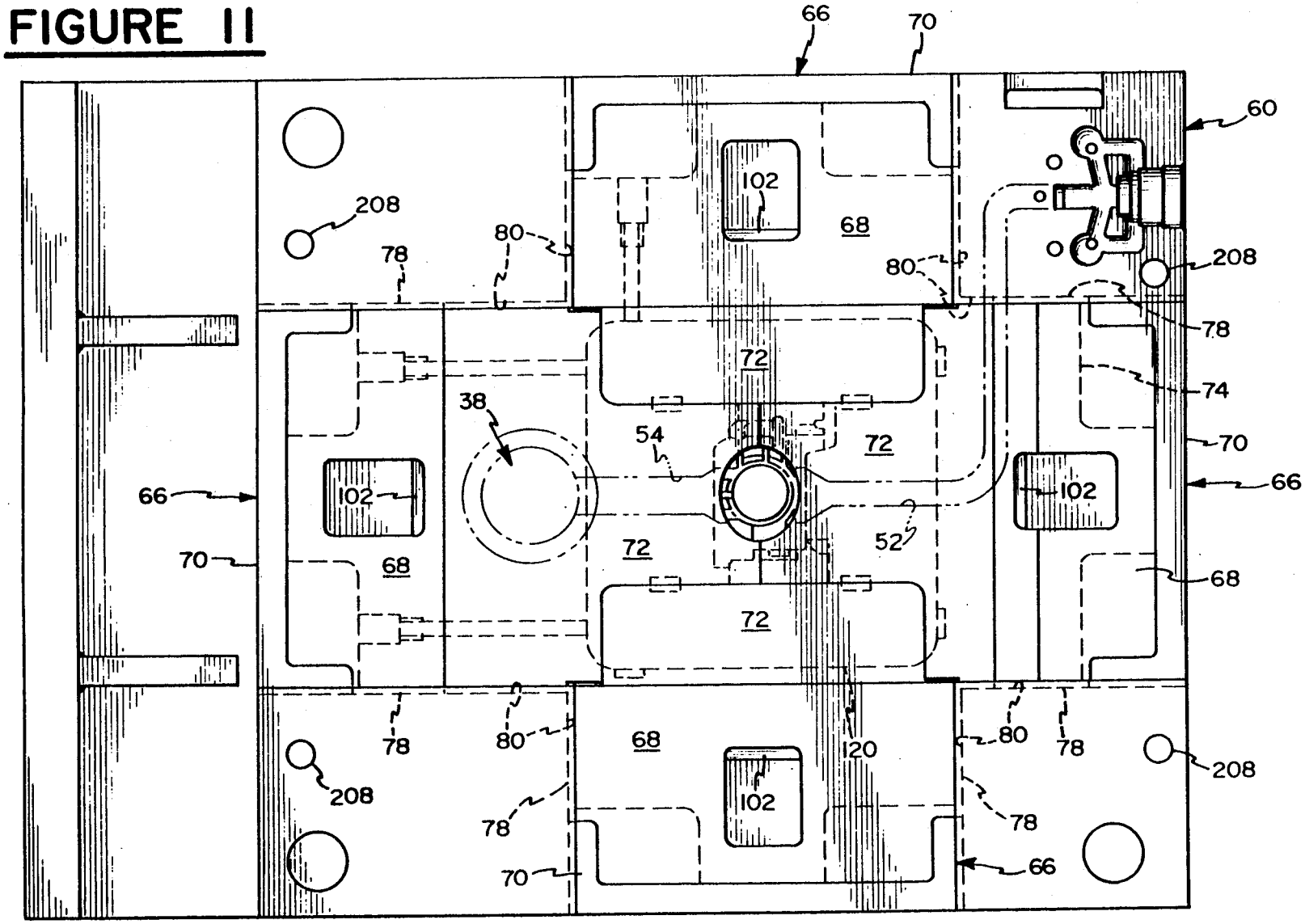
FIG. 11 is a top plan view of the ejector half at the main parting line of the frame of FIG. 1.

A top plan view of the ejector half 4 is disclosed in FIG. 11. The shot hole 38 and the recesses 52 and 54 disposed on the opposing surface of the cover half 2 are shown in dashed lines.

Operation

In operation, the frame R is clamped to a die casting machine (not shown) where the conversion clamp plate 14, if required, or the cover clamp plate 12 is secured to the stationary platen of the die casting machine. The ejector clamp plate 182 is mounted to the movable platen of the die casting machine. The frame R is oriented when secured in the machine such that its side 224 is oriented towards the bottom and the side 226 is oriented towards the top, as best shown in FIG. 1. To start the cycle of die casting a part, the die faces are first lubricated and the frame R is closed, as shown in FIG. 1. Molten metal is injected through a shot sleeve (nol shown) inserted in the shot hole 38 while the vacuum blocks 56 and 60 draw a vacuum within the mold cavity. The molten material cures to a preset time. The die casting machine then opens the frame R along the main parting line 6, separating the cover half 2 from the ejector half 4. The slide carriers 66 are then retracted outwardly by the piston/cylinder assemblies 86. The main ejector plate 190 is then activated by the piston/cylinder assemblies 192, causing the main ejector plate 190 to move toward the backup plate 180, thereby causing the sub-ejector plates 168 to move the ejector pins 200 through the holes 202 to eject the die cast part. The plate 190 is then retracted by the piston/cylinder assemblies 192, the die faces are lubricated, the slide carriers 66 are brought forward to the closed position by means of the piston/cylinder assemblies 86 and the die casting machine closes the frame R whereby the bottom planar surface of the cover half 2 mates with the planar top surface of the ejector half 4. The above cycle is then repeated.

Maintenance

Slide Nose Blocks

When maintenance is required on the die faces of the various mold blocks 20 and 148 and slides noses 72, it is a relatively simple operation to remove the affected die block without a complete tear down of the frame R.

To replace the slide noses 72, the bolts 73, which are accessible from the outside through carrier bracket 70, are removed and the slide noses 72 separate from their respective slide carriers 66 along their respective interfaces. In this manner the entire slide carrier 66 advantageously need not be disconnected from the frame R. The slide noses 72 can then be worked on or replacement slide noses can be readily screwed back on to the slide carriers 66.

In the prior art frame where the slide carrier is integral with the slide nose, the entire slide carrier had to be removed from the frame in order to work on the slide nose portion. Also in the prior art frame, the piston/cylinder assemblies that actuate the slide carriers are installed outboard of the frame such that disassembly of the piston/cylinder is necessary before the slide carrier can be removed. When the slide nose 72 is disconnected from the slide carrier 66, the fluid circuit that feeds the slide nose from the ejector manifold retainer plate 92 advantageously need not be disconnected from the slide carrier 66. O-rings at the interfaces between the slide nose 72 and the slide carrier 66 provide sealing means between the passageways 88 and 90 in the slide nose 72 and the carrier 66, respectively.

Cover Cavity Block

To gain access to the cover cavity block 20, the unit 42 is separated from cover clamp plate 12 by undoing the securing bolts (not shown) from the cover clamp plate 12 or conversion plate 14. The cover half 2 is then parted between the plates 10 and 12. Bolts that secure the plate 10 to plate 12 are accessible from the plate 12 if the plate 14 is not used, or from the plate 14. The plates 12 and 14 remain secured to each other as a unit during this operation and are simply lifted out of the way to expose the backside of the manifold block 22. The cover manifold block 22 which is secured to the cover cavity block 20 can then be lifted out from the pocket 16. The cover cavity block 20 is then separated from the cover manifold block 22 by undoing their connecting screws (not shown). The internal cooling circuit that feeds the cover cavity block 20 interfaces with the circuit in the cover manifold block 22 by means of O-rings (not shown), similar to the interface between the slide nose 72 and the slide carrier 66. A new or refurbished cover cavity block 20 is then screwed back to the cover manifold 22 and the assembly then repositioned inside the pocket 16. The locator plates 48 and the locator pins 50 in threaded holes (not separately shown) assure consistent and repeatable positioning, regardless of the condition of the pocket 16. The plates 12 and 14 are then bolted back to plate 10. In this operation, the cooling circuit in the plate 10 is advantageously not unnecessarily disturbed.

Wedge Blocks

Although the wedge blocks 26 rarely need servicing because of the use of wear plates 102, 104 and 106, the bolts that secure the wedge blocks 26 to the plate 10 are accessible when the separable cover unit 42 is separated from the cover clamp plate 12.

Ejector Cavity Block

If access is required to the ejector cavity block 148, the unit 210 is separated from the ejector manifold retainer plate 92. Bolts that connect the unit 210 to the plate 92 are accessible from the ejector clamp plate 182. Bolts that secure the sub-ejector plates 168 to the dowels 196 are also unscrewed from plate 182. When these screws are undone, the unit 210 is simply lifted out, exposing the sub-ejector plates 168 and the ejector manifold block 154. At this point of the disassembly, access to the ejector pins 200 is then provided. Advantageously, if the pins 200 have been broken or need to be rearranged for a different part, it is a simple task to provide a new ejector pin arrangement. The ejector manifold block 154, which is connected to the ejector cavity block 148, can then be lifted out of the pocket 124 to be worked on. The fluid passages from the ejector manifold block 154 and the ejector cavity block 148 are interconnected with O-rings at their interface, similar to the arrangement disclosed for the slide carrier 66 and the slide nose 72. A new or refurbished ejector cavity block 148 is then bolted back to the ejector manifold block 154 and the whole assembly is slipped into the pocket 124 and the unit 210 is then bolted back to plate 92. In this operation, the heating, cooling and hydraulic fluid circuits for the slide carriers 66 disposed in the ejector cavity retainer plate 74 and the ejector manifold plate 92 are advantageously not disturbed. Similarly, the hydraulic circuit for the piston cylinder assemblies 192 disposed in the backup plate 180 are similarly not disturbed.

The cables connected to the slide carrier limit switches (not shown) are housed in grooves in the back of the ejector cavity retainer plate 74. The ejector manifold plate 92 encloses the cables. These cables are advantageously not removed during normal cavity block replacement and are protected when the frame R is used.

The piston/cylinder assemblies 192 provide an onboard actuating means for the ejector pins 200. This is advantageous in situations where the die casting machine does not have the actuating means to operate the ejector pins 200. Therefore, the frame R can be advantageously used in various die casting machines.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth and fall within the scope of the invention or the limits of the appended claims.

The embodiments of the invention in which an exclusive property or privilege is claimed are defined as follows:

1. A frame for manufacturing die cast parts in a die casting machine, the frame comprising a cover half adapted to be attached to the stationary side of a die casting machine platen and an ejector half adapted to be attached to the movable side of a die casting machine platen, the cover half and the ejector half having a closed position at a main parting plane for die casting a part and an open position for ejecting a die cast part, the cover half comprising a cover cavity retainer plate and a cover manifold retainer plate, said plates being stacked and clamped together to define a pocket to receive and support a cover mold block, passages to accommodate heating/cooling of said mold block and a passage for molten metal into said mold block, the ejector half comprising an ejector cavity retainer plate, an ejector manifold plate and cast part ejector means, said plates being stacked and clamped together to define a pocket to receive and support an ejector mold block and fluid passages for cooling said ejector mold block, a said cover mold block and a said ejector mold block being accessible in and removable from their respective pockets when the cover half and ejector half are in their open positions.

2. A frame for manufacturing die cast parts, in a die casting machine, the frame comprising a cover half adapted to be attached to the stationary side of a die casting machine platen and an ejector half adapted to be attached to the movable side of a die casting machine platen, the cover half and the ejector half having a closed position at a main parting plane for die casting a part and an open position for ejecting a die cast part, the frame having an axis coincident with the open/close axis of a said die casting machine and said cover half and ejector half each having a die casting machine platen end and a main parting plane surface end, the cover half comprising a cover cavity retainer plate and a cover manifold retainer plate, said plates being aligned transverse to the frame axis and stacked and clamped together with the cover cavity retainer plate positioned toward the main parting plane of the cover half to define a pocket to receive and support a cover mold block, passages to accommodate heating/cooling of said mold block and a passage for molten metal into said mold block, the ejector half comprising an ejector cavity retainer plate, an ejector manifold plate and cast part ejector means, said plates being aligned transverse to the frame axis and stacked and clamped with the ejector cavity retainer plate positioned toward the main parting plane of the ejector half and to define a pocket to receive and support an ejector mold block and fluid passages for cooling said ejector mold block, a said cover mold block and a said ejector mold block being accessible in and removable from their respective pockets when the cover half and ejector half are in their open positions.

3. A frame as recited in claim 2 where the cover half comprises a first unit and a second unit, the second unit including said cavity retainer plate and said cover manifold retainer plate and the first unit being adapted to attach said second unit to the cover platen of the die casting machine, said ejector half comprising a first unit and a second unit where the second unit includes said ejector cavity retainer plate and an ejector manifold plate and the first unit comprises plate units for affixing the second unit to the ejector platen of the die casting machine, each of said first and second units of said cover and ejector halves having cooperating and separable planar parting surfaces.

4. A frame as recited in claim 2 where the cover half and ejector half each comprise an opposing complementary vacuum block member that in the frame closed position abuts to form a portion of the main parting plane surface of the frame and cooperate with each other and the mold blocks to define a passage for evacuation of air from the mold cavity.

5. A frame as recited in claim 2 where the ejector half comprises at least one core slide means and complementary corner block means carried by said ejector cavity retainer plate, the said slide means and corner block means cooperating to define a face for engagement with a corresponding face on the cover cavity plate means, such die faces forming main parting plane surfaces of the frame.

6. A frame as recited in claim 5 wherein the ejector cavity retainer plate is adapted to carry hydraulic means for actuating a said slide means between a slide closed position when the die casting machine and frame are closed for defining a portion of the die cavity and a slide open position when the die casting machine and frame are in their open position.

7. A frame as recited in claim 2 in which the cast part ejector means comprises a main ejector plate and a secondary ejector plate, the secondary ejector plate being actuated by the main ejector plate and including ejector pins configured to eject the specific casting shape to be formed in the ejector mold block.

8. A frame for manufacturing die cast parts in a die casting machine, the frame comprising a cover half adapted to be attached to the stationary side of a die casting machine platen and an ejector half adapted to be attached to the movable side of a die casting machine platen, the cover half and the ejector half having a closed position at a main parting plane for die casting a part and an open position for ejecting a die cast part, the frame having an axis coincident with the open/close axis of a said die casting machine and said cover half and ejector half each having a die casting machine platen end and a main parting plane end, the cover half comprising a cover cavity retainer plate and a cover manifold retainer plate, said plates being aligned transverse to the frame axis and being adapted to be clamped together with the cover cavity retainer plate positioned toward the main parting plane of the cover half to define a pocket to receive and support a cover mold block, the ejector half comprising an ejector cavity retainer plate, an ejector manifold plate and cast part ejector means, said plates being aligned transverse to the frame axis and being adapted to be clamped with the ejector cavity retainer plate positioned toward the main parting plane of the ejector half and to define a pocket to receive and support an ejector mold block, the ejector half further comprising at least one slide means adapted to be carried by said ejector cavity retainer plate so as to form a portion of the part defining cavity surface and the ejector half of the main parting plane surface, the said slide means comprising a separable and replaceable slide nose portion configured to define a portion of the part mold cavity, a said cover mold block, a said ejector mold block and a said slide nose each being accessible and removable from the frame when the cover half and ejector half are in their open positions.

9. A frame as recited in claim 6 or claim 8 wherein the cover manifold retainer plate comprises a slide locking wedge block rigidly mounted on it that is adapted to engage a said slide means and lock it into a closed position when the die casting machine is closed, said slide locking block being further adapted to mechanically strip said slide means from the cast part when the die casting machine is opened.

10. A frame for manufacturing die cast parts in a die casting machine, the frame comprising a cover half adapted to be attached to the stationary side of a die casting machine platen and an ejector half adapted to be attached to the movable side of a die casting machine platen, the cover half and the ejector half having a closed position at a main parting plane for die casting a part and an open position for ejecting a die cast part, the frame having an axis coincident with the open/close axis of a said die casting machine and said cover half and ejector half each having a die casting machine platen end and a main parting plane end, the cover half comprising a cover cavity retainer plate and a cover manifold retainer plate, said plates being aligned transverse to the frame axis and being adapted to be clamped together with the cover cavity retainer plate positioned toward the main parting plane of the cover half to define a pocket to receive and support a cover mold block and a passage for molten metal into said mold block, said cavity retainer plate and said manifold retainer plate comprising a plurality of datum surfaces adapted for accurate and reproducible positioning of a said cover mold block, the ejector half comprising an ejector cavity retainer plate, an ejector manifold plate and cast part ejector means, said plates being aligned transverse to the frame axis and being adapted to be clamped with the ejector cavity retainer plate positioned toward the main parting plane of the ejector half and to define a pocket to receive and support an ejector mold block, said cavity retainer plate and manifold retainer plate comprising a plurality of datum surfaces adapted for accurate and reproducible positioning of a said ejector mold block, a said cover mold block and a said ejector mold block being accessible in and removable from their respective pockets when the cover half and ejector half are in their open positions.

* * * * *